United States Patent [19]

Willhite

[11] 3,951,359

[45] Apr. 20, 1976

[54] MISSILE CONTROL SYSTEM

[75] Inventor: Charles C. Willhite, Greensboro, N.C.

[73] Assignee: The United States of America as represented by the Secretary of the Army, Washington, D.C.

[22] Filed: Jan. 28, 1966

[21] Appl. No.: 523,807

[52] U.S. Cl. ..... 244/3.14
[51] Int. Cl.[2] ..... F41G 7/14
[58] Field of Search ..... 244/3.11, 3.14, 3.15, 244/3.19

[56] References Cited

UNITED STATES PATENTS

| | | | |
|---|---|---|---|
| 3,338,534 | 8/1967 | Girsberger | 244/3.14 |
| 3,363,858 | 1/1968 | Dobbins et al. | 244/314 |
| 3,374,967 | 3/1968 | Plumley | 244/3.14 |
| 3,405,888 | 10/1968 | Okamoto | 244/3.14 |

*Primary Examiner*—Verlin R. Pendegrass
*Attorney, Agent, or Firm*—Nathan Edelberg; Robert P. Gibson

[57] ABSTRACT

Initial turn circuits for providing steering orders for a missile including a first computer for providing a critical turn angle signal, a second computer for providing a difference turn angle signal and circuitry for combining these signals for providing a signal related to a turn angle which would prevent the missile from passing directly over the tracking radar antenna during an "over-the shoulder" firing.

8 Claims, 16 Drawing Figures

Figure 1:
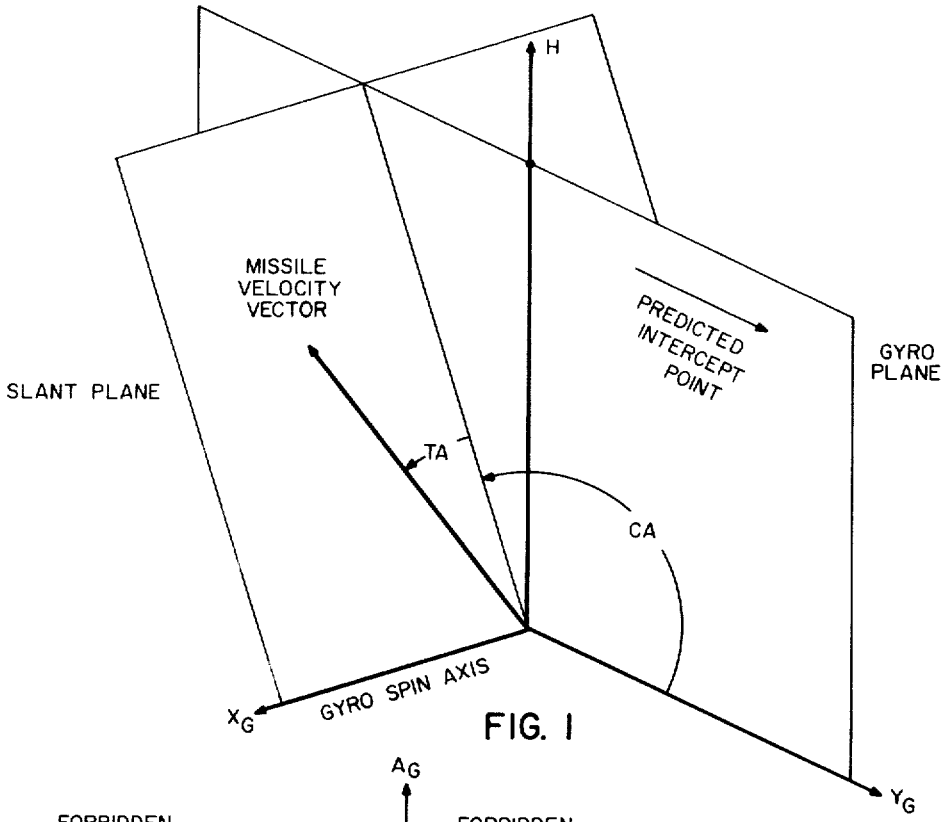

Charles C. Willhite,
INVENTOR.
Harry M. Saragovitz
BY Edward J. Kelly
Herbert Berl
Alfred E. Smith Charles C. Willhite,
INVENTOR.

BY Harry M. Saragovitz
Edward J. Kelly
Herbert Berl
Alfred E. Smith

Charles C. Willhite,
INVENTOR.

BY Harry M. Saragovitz
Edward J. Kelly
Herbert Berl
Alfred E. Smith

Charles C. Willhite,
INVENTOR.
Harry M. Saragovitz
BY Edward J. Kelly
Herbert Berl
Alfred E. Smith Charles C. Willhite,
INVENTOR.
BY Harry M. Saragovitz
Edward J. Kelly
Herbert Berl
Alfred E. Smith Charles C. Willhite
INVENTOR.
Harry M. Saragovitz
BY Edward J. Kelly
Herbert Berl
Alfred E. Smith Charles C. Willhite,
INVENTOR.
Harry M. Saragovitz
BY Edward J. Kelly
Herbert Berl
Alfred E. Smith Charles C. Willhite,
INVENTOR.
BY Harry M. Saragovitz
Edward J. Kelly
Herbert Berl
Alfred E. Smith Charles C. Willhite
INVENTOR.
BY Harry M. Saragovitz
Edward J. Kelly
Herbert Berl
Alfred E. Smith

MISSILE CONTROL SYSTEM

This invention relates generally to missile control systems and more particlarly to initial turn circuits for controlling a missile during the initial part of its flight.

The effective field of fire of conventional anti-aircraft artillery is restricted at high elevation angles both by limitations in loading and controlling the gun, and by excessively high tracking rates for the associated radar equipment. With a guided missile system, the first limitation no longer applies, but the second remains. This application describes a system for overcoming this second limitation in surface-to-air missile systems.

As indicated above, the characteristics of the missile tracking radar are such that it cannot track a missile that passes close to or directly overhead. Missiles that pass close to the radar will cause high azimuth rates, and as the distance decreases, rates in excess of the azimuth tracking capability will be required to keep the missile in the radar beam. The missile path from the launcher to the predicted impact point, therefore, must be controlled so as to (1) avoid the "forbidden region" near the antenna azimuth axis where the missile may be lost, and (2) direct the missile to intercept the target.

When the path of the missile is such that steering orders are required to avoid the forbidden region, the firing is termed an "over-the-shoulder" engagement. The missile is directed out of the plane containing the missile-tracking-antenna and the predicted intercept point. After passing the antenna at a safe distance, and completing the initial dive, the missile is steered to intercept.

The initial turn circuits form an integral part of the computer which issues turn orders as required to cause the missile to fly with the proper heading during the initial part of the flight. This operation is completely automatic and as such requires no attention from any operating personnel. For over-the-shoulder engagements the missile is flown with a skirting turn angle around the forbidden region. For all other engagements the missile is flown in a plane close to and parallel to the vertical plane containing the launcher and predicted impact point. In the general case, roll amount gyro errors, uneven booster thrust, and launcher tilt would cause the missile heading to differ from the desired direction at the start of and during the initial dive. However, turn orders to the missile correct for these disturbances and cause the missile to go to and stay on the desired heading.

In some missiles the fins are oriented at 45° with respect to the climb and turn directions. With this orientation the presence of a turn acceleration reduces the maximum dive acceleration that may be applied. For over-the-shoulder engagements large initial turn maneuvers are performed during the initial dive, and thus the size of the dead zone and the time-of-flight to intercept are increased. The magnitude and duration of the initial turn oders are, therefore, kept as small as possible.

The desired initial turn angle is computed using ballistic functions of emplacement geometry and missile position, heading, and velocity. The actual missile turn angle is controlled by a closed loop servo system which causes the missile to come to and stay on the desired turn angle.

Accordingly it is an object of this invention to provide a missile system capable of making over-the-shoulder engagements.

It is a further object of this invention to provide a missile system having a capability of intercepting a target approaching from any direction.

A still further object of this invention is to provide a means for computing the desired initial turn angles for an interceptor missile.

Figure 2A:
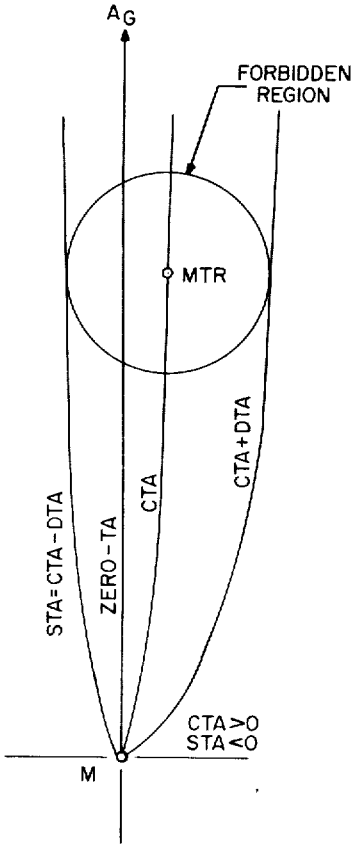
Figure 2B:
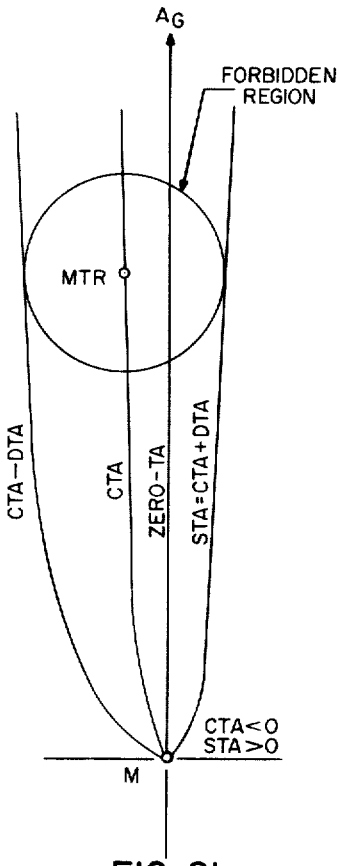
Figure 3:
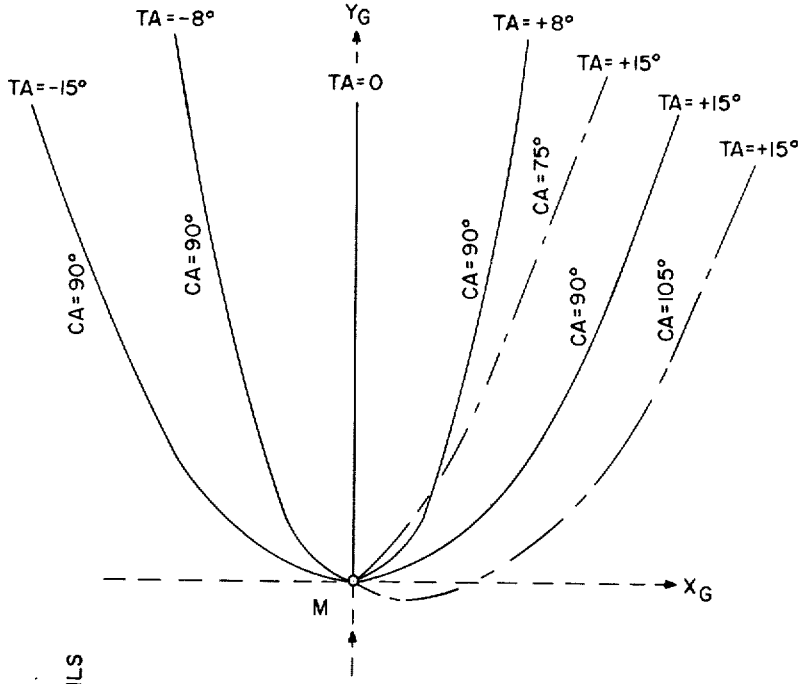
Figure 4:
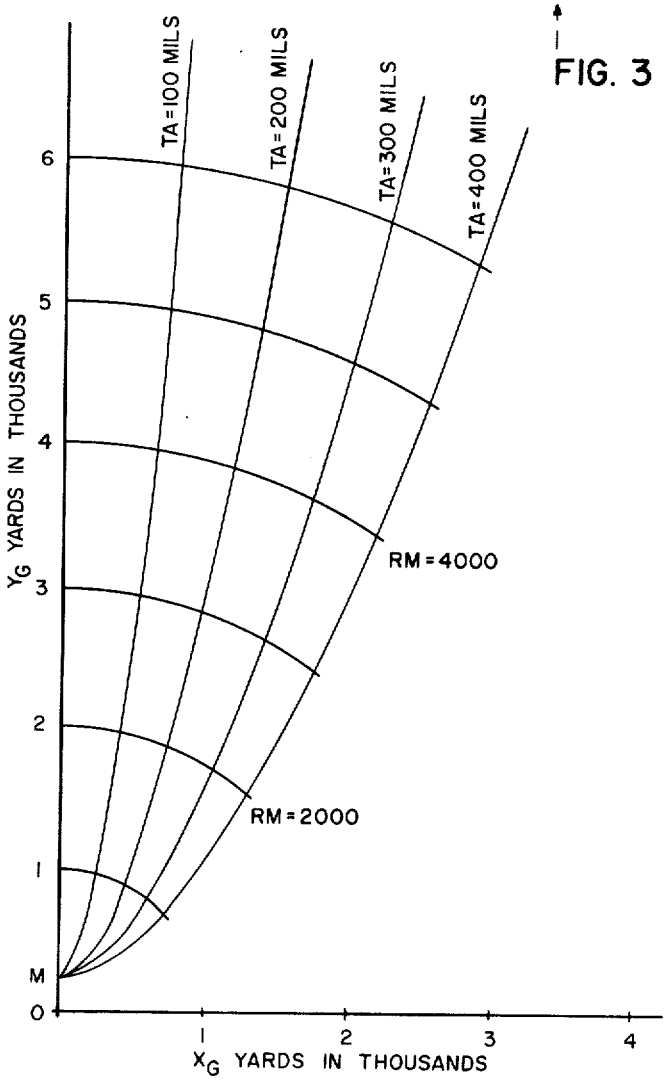
Figure 5:
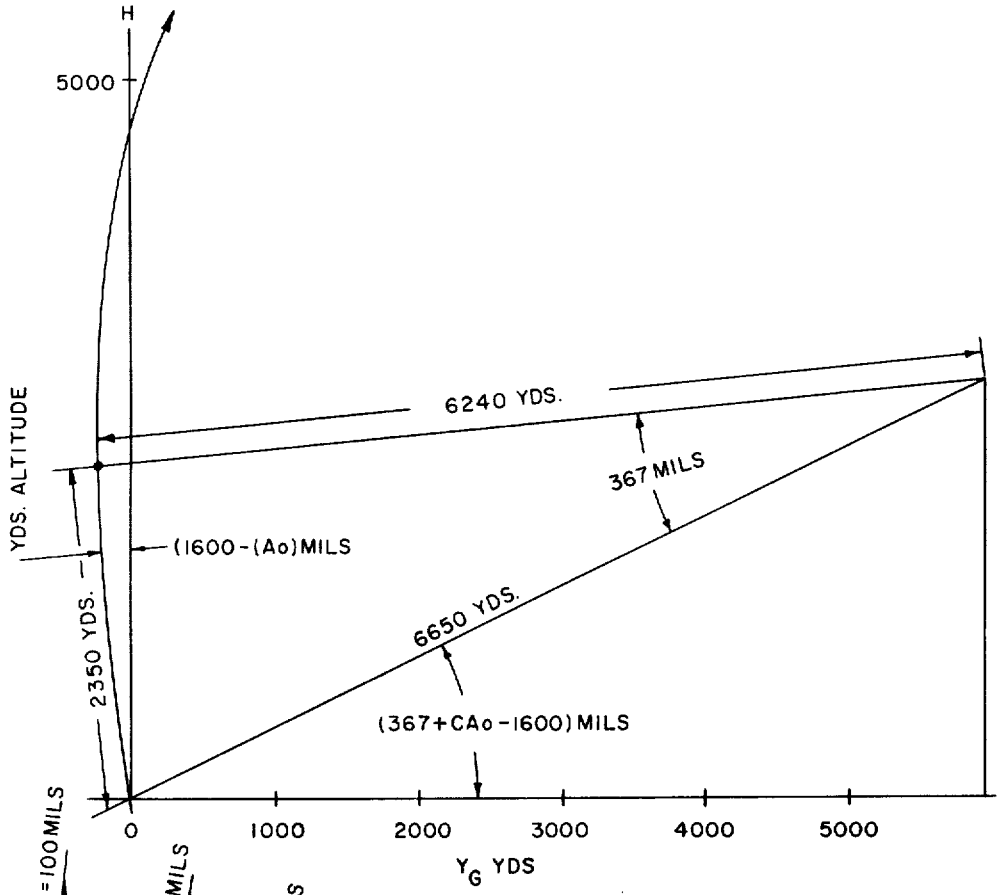
Figure 7:
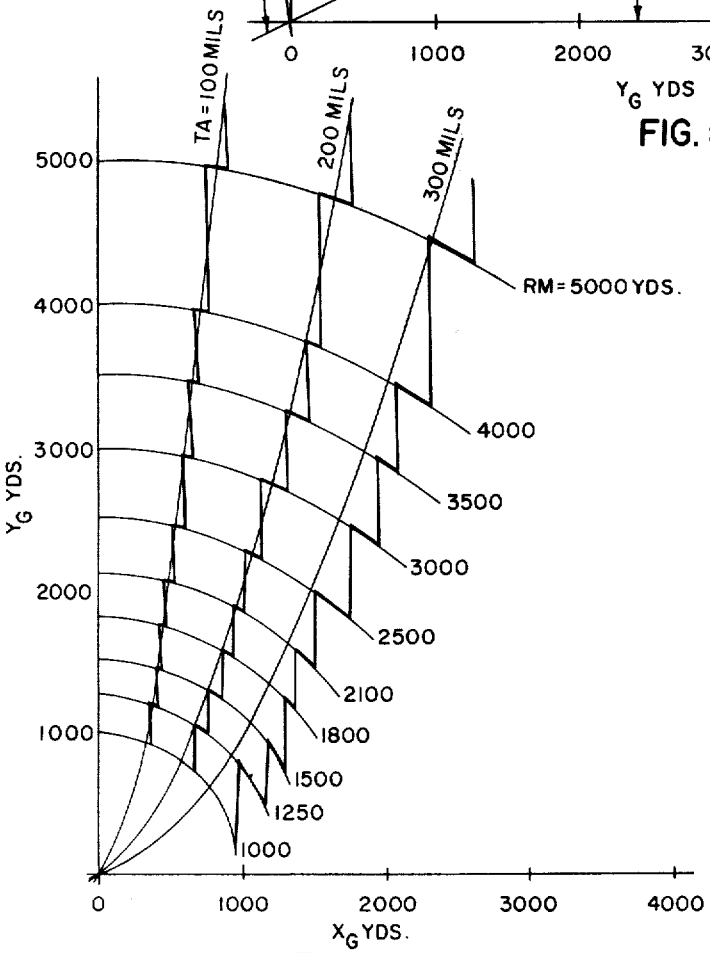
Figure 6:
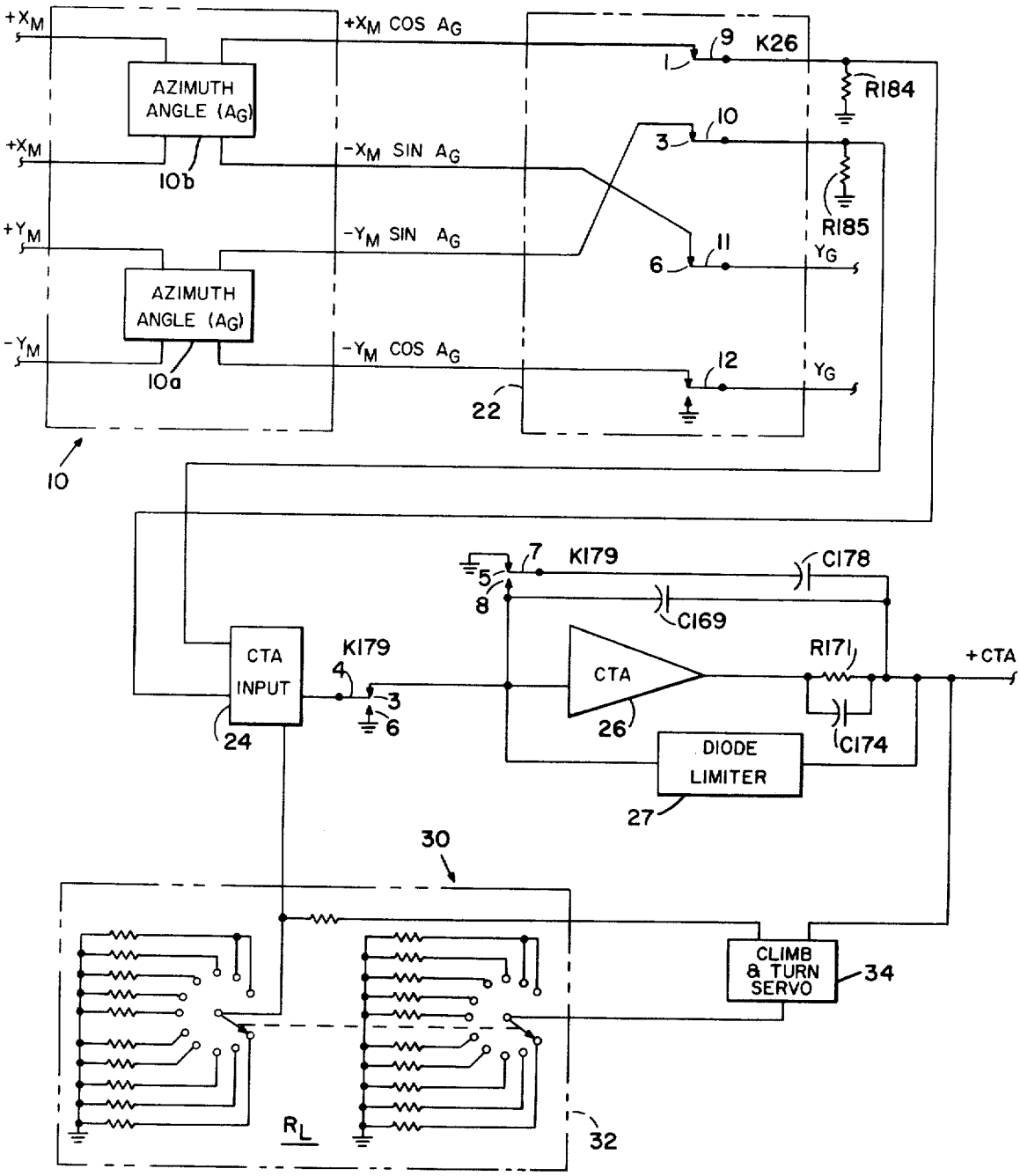
Figure 9:
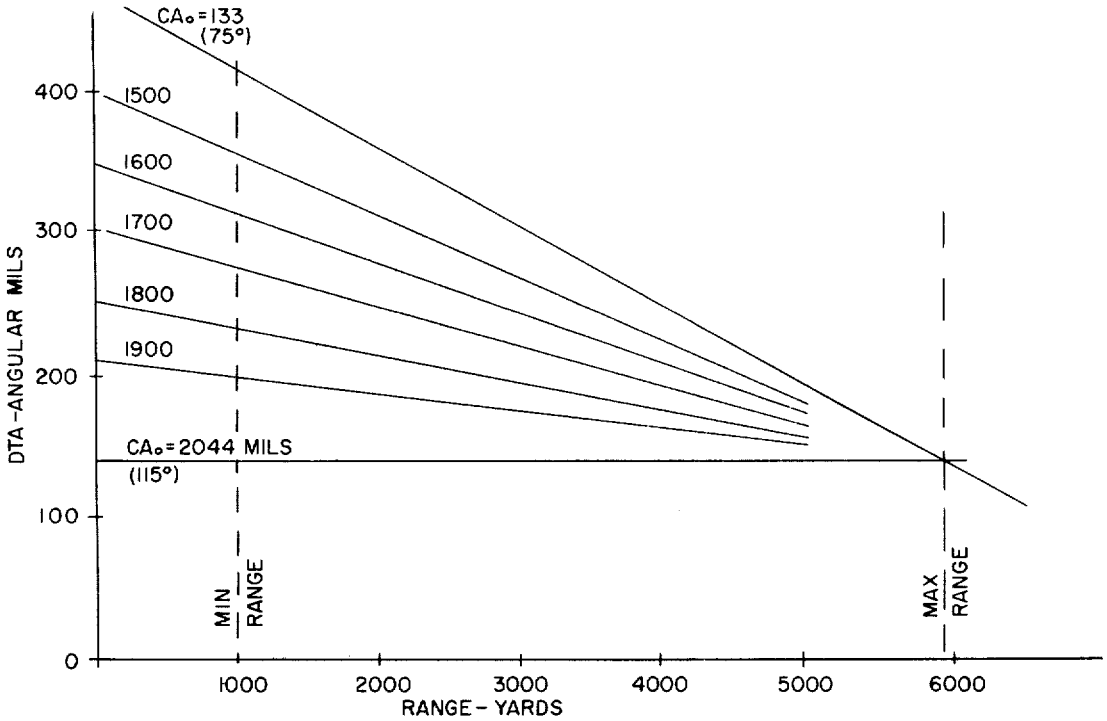
Figure 8:
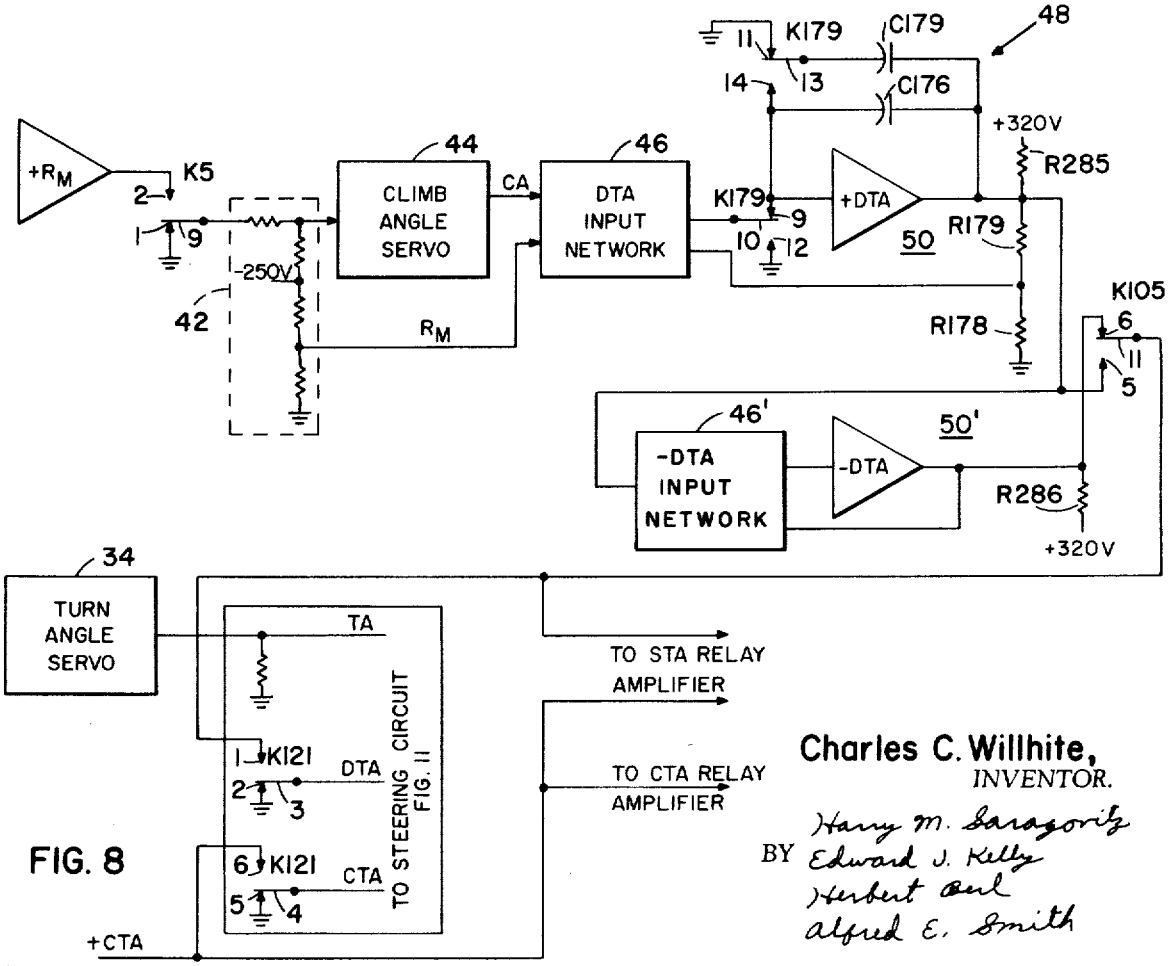
Figure 10A:
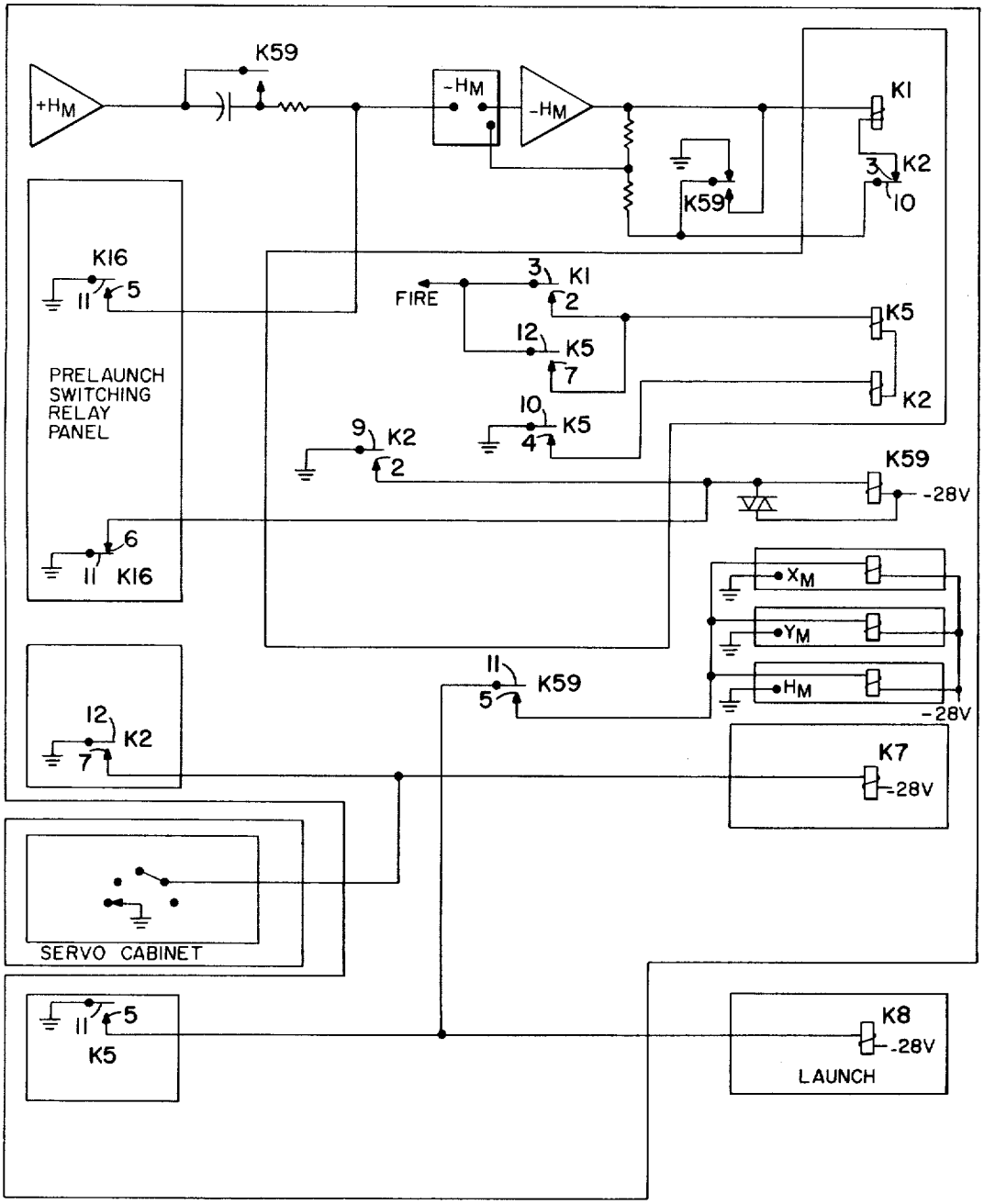
Figure 10B:
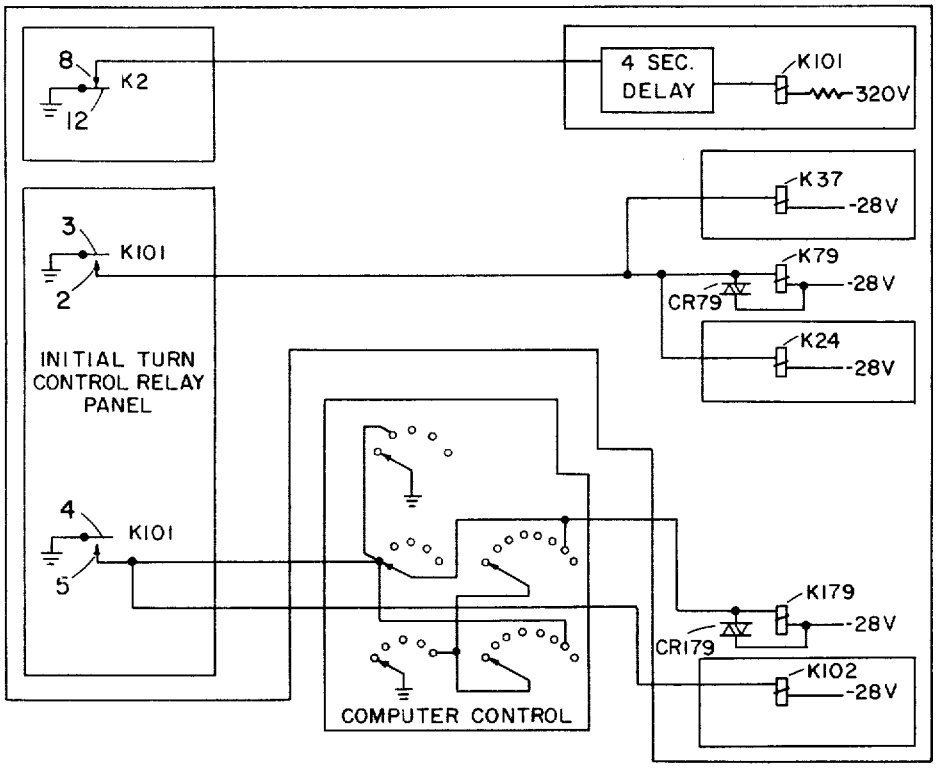
Figure 10C:
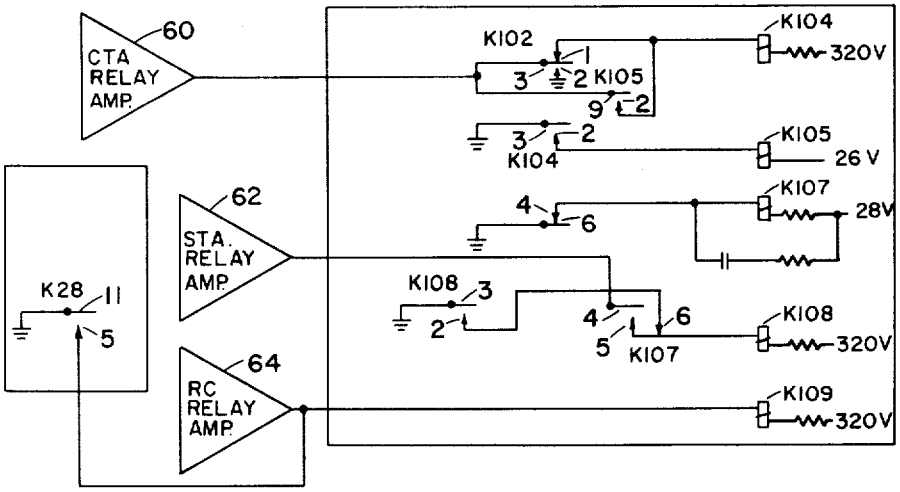
Figure 10E:
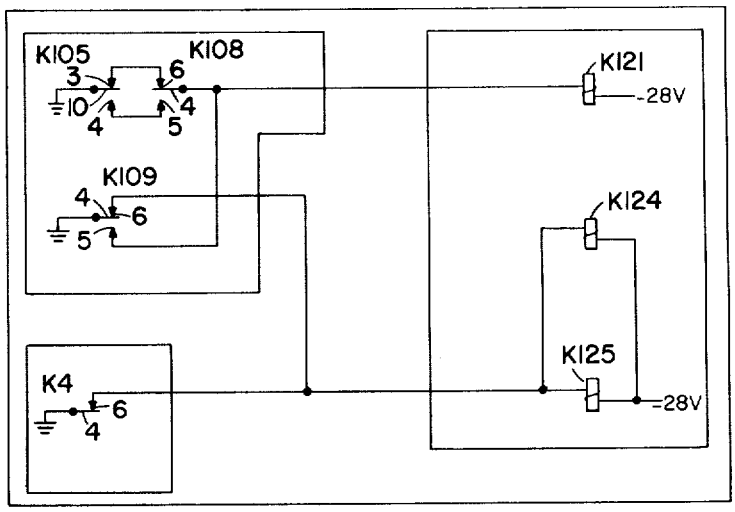
Figure 10D:
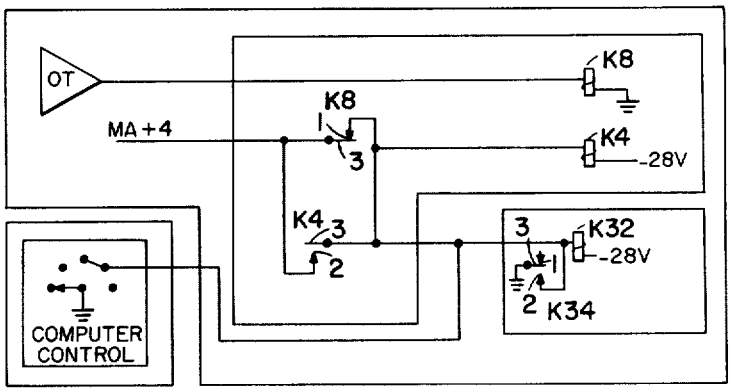
Figure 11:
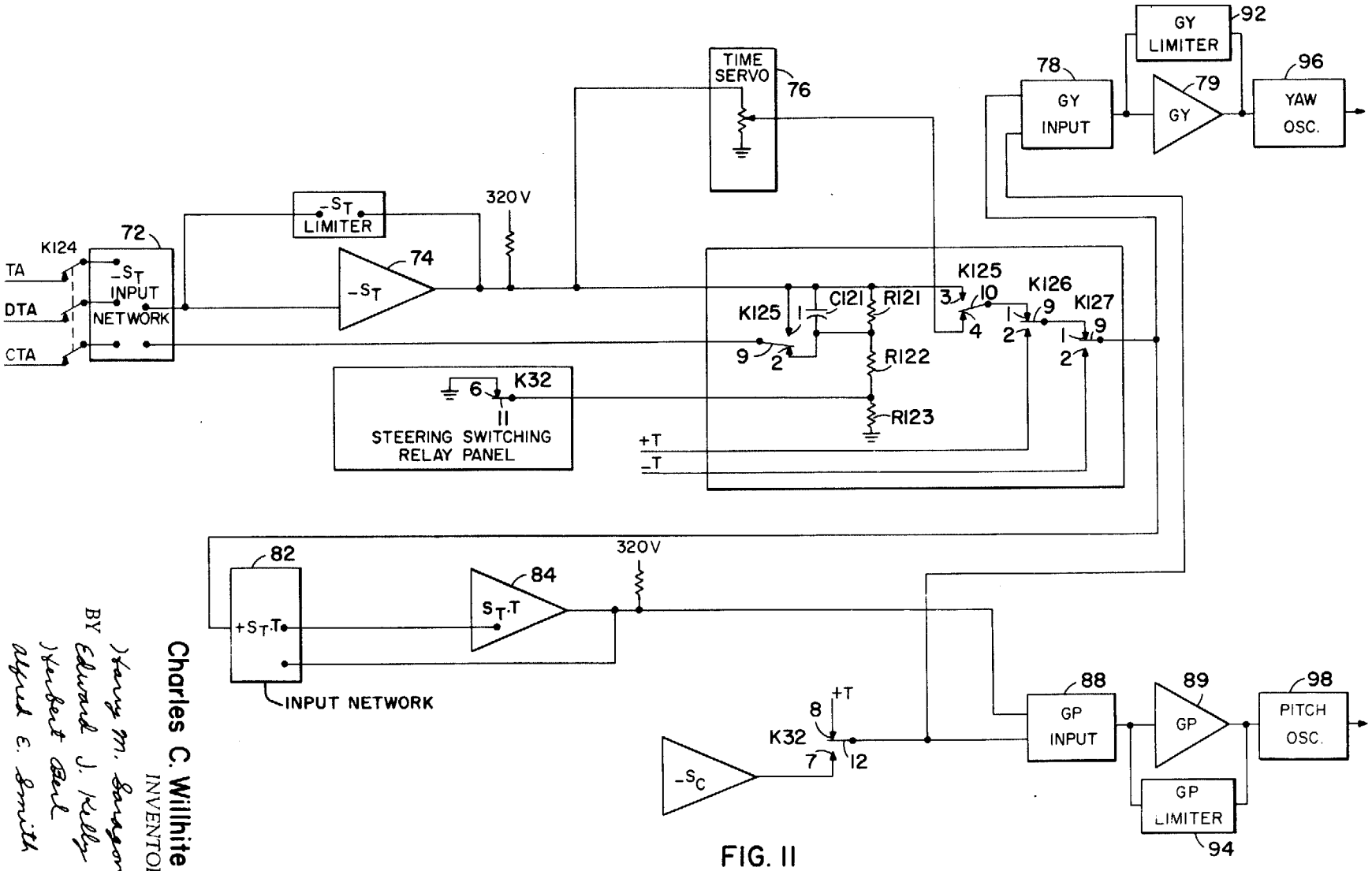

These and other objects and advantages as well as characteristic features and details of construction of this invention may best be understood by reference to the following description, taken in conjunction with the accompanying drawings, in which:

FIG. 1 illustrates missile climb and turn angle geometry,

FIGS. 2(*a*) and 2(*b*) are plan views of missile trajectories for various turn angles, FIG. 3 is a plan view of missile trajectories for various turn angles and initial climb angles, FIG. 4 illustrates the horizontal components of missile trajectories, FIG. 5 is a gyro plane projection of a missile trajectory, FIG. 6 is a schematic diagram of a computer forming a component of the initial turn angle circuits, FIG. 7 illustrates the output of a critical turn angle amplifier, FIG. 8 illustrates another component of the initial turn angle circuits, FIG. 9 illustrates the difference turn angle circuit characteristics, FIGS. 10(*a–e*) are schematic diagrams of the computer condition relay circuits, and FIG. 11 is a schematic diagram of acceleration order-to-fins circuits.

In order to understand the operation of the missile control system to be described in detail herein a knowledge is required of (1) missile control system geometry, (2) definitions of events, and (3) definitions of quantities appearing in the computer.

The following definitions which concern basic system geometry are of importance in the initial turn problem, which has been solved by this invention. Missile orientation is determined with respect to the gyro plane and the slant plane as shown in FIG. 1. The gyro plane is a vertical plane passing through the launcher and the predicted intercept point as determined by prelaunch computation. In FIG. 1 the predicted intercept point is in the right half of the gyro plane. The slant plane is determined by the missile velocity vector and the gyro spin axis (which is normal to the gyro plane). The missile velocity vector, which is the tangent to the path of the missile, differs from the longitudinal missile axis by the angle of attack.

The missile climb angle (CA), is the angle between the slant plane and the horizontal plane. The missile turn angle (TA), measured in the slant plane, is the angle between the missile velocity vector and the gyro plane. The turn angle is a measure of the rate at which the missile is traveling relative to the gyro plane.

Three events which require definition are roll stabilization, radar cleared and on trajectory.

Roll stabilization (which is better described as "roll stabilization completed") occurs 4½ seconds after the computer detects missile away (7½ seconds after fire). The first orders are transmitted to the missile at this time. The process of roll stabilization is accomplished by the missile roll amount gyro servo system. This action, which is initiated at missile-booster separation, causes the missile body to rotate about the longitudinal axis until the fins have the proper orientation with respect to the slant plane.

Radar cleared (RC) occurs when the missile passes through the vertical plane normal to the gyro plane which includes the tracking antenna. This event occurs only during over-the-shoulder engagements. At radar cleared the missle is normally at minimum ground range from the radar.

On trajectory (OT) occurs when the initial dive (normally 7G) is completed and the programed dive order is removed from the missile. After OT the missile is controlled by the steering section of the computer, and will normally be flying a ½G glide bias trajectory toward the predicted intercept point.

The following quantities are of importance in over-the-shoulder engagements and enter into the computation of initial turn angles. Note that the turn angles are measured in the slant plane which is necessarily in motion during the initial dive. Because of this, these angles cannot normally be shown in their true sizes on any of the geometric representations of the engagement.

The path of this missile in space from roll stabilization to radar cleared is a helical segment. The radius (approximately 6000 yards) is determined by missile velocity and dive acceleration. The pitch of the helix corresponds to the missile turn angle. FIGS. 2 and 3 which will be discussed in more detail later, show plan projections of theoretical trajectories for various turn angles and for specific climb angles at roll stabilization.

The critical turn angle (CTA) is that turn angle which if maintained from Roll Stabilization will cause the plan projection of the missile path to pass through the missile tracking antenna. This is the turn angle that must be avoided.

The forbidden region is the region about the missile tracking radar antenna where the antenna tracking capabilities may be exceeded.

The difference turn angle (DTA) is the turn angle change from CTA required to move the missile path projection so that it will just skirt the forbidden region.

The skirting turn angle (STA) is the smaller of the two possible angles which will cause the missile trajectory to skirt the forbidden region. Logic circuits in the computer combine CTA and DTA in the proper polarities to select STA, the turn angle closest to the gyro plane. CTA, DTA, and STA are computed continuously until roll stabilization and held constant thereafter.

At the completion of roll stabilization the initial turn section of the computer develops orders as required to cause the missile to go to and stay on the proper turn angle. For non-over-the-shoulder engagements, the missile is flown with zero turn angle during the initial dive. This zero turn angle is selected by the computer whenever the normal path to the predicted intercept point lies outside the forbidden region. Small turn orders to the missile are necessary in this case in order to correct for launcher tilt, booster thrust alignment, and the other factors.

When the predicted path to the intercept point intersects the forbidden region, then the missile is flown with a skirting turn angle which is computed from CTA and DTA. The critical turn angle is determined once the missile-to-antenna ground range, the displacement of the antenna normal to the gyro plane, and the missile climb angle are specified. When the climb angle is greater than 1600 mils, the path of the missile is at first away from the predicted intercept point. DTA is computed as a function of the missile climb angle and range to the antenna. The computed values of CTA, DTA and STA are held constant after roll stabilization.

FIGS. 2 and 3 serve to illustrate some of these points. In each of the diagrams of FIG. 2, the trajectories indicated are the plan views of the missile flight paths obtained by causing the missile to fly with a fixed turn angle. This figure assumes a 1600 mil (90°) climb angle at roll stabilization. In each case the trajectories marked CTA extend from the launcher at point M through the point MTR (missile tracking radar). The two trajectories which are tangent to the forbidden region are CTA ± DTA. In either figure the desired flight path is the trajectory corresponding to the smaller of the two angles CTA + DTA or CTA − DTA. In FIG. 2*a* this is CTA − DTA and in FIG. 2*b* CTA + DTA. The computer logic circuits select the smaller of the two angles, STA. This flight path will cause less deviation of the missile from a direct heading toward the impact point (along the $A_G$ line).

FIG. 3 illustrates the plan view of some trajectories formed; (1) for various initial climb angles when the missile is flown with a turn angle of 15°, and (2) for a 90° initial climb angle when the missile is flown at four different turn angles. The initial turn circuits make use of the information presented in these figures in computing CTA, DTA and STA.

The operation of the initial turn circuits during an over-the-shoulder engagement may be visualized in the following manner:

1. The antenna-to-launcher distance which serves as an approximation to antenna-to-missile ground range is hand-set into the computer before firing.
2. The computer determines $X_G$ and climb angle from tracking data.
3. The values of antenna-to-launcher distance and $X_G$ fix the position of the missile tracking radar on the trajectory chart (FIG. 3).
4. The curve which corresponds to CA at roll stabilization and passes through MTR defines the critical turn angle.
5. The antenna-to-missile ground range and initial climb angle determine the size of the forbidden region, and therefore DTA.

When the missile is steered around the forbidden region and the launcher is close to the radar, radar cleared will usually occur before on trajectory. In this case the missile is ordered to fly a zero turn angle (parallel to the gyro plane) between radar cleared and on trajectory. On the other hand, if the launcher is not close to the radar, the missile may complete the initial dive before clearing the radar. In the latter circumstance, the climb orders are developed by the steering section of the computer, while the initial turn section of the computer controls the turn order which causes the missile to stay on the skirting trajectory until radar cleared. In either case, the initial turn phase of the flight is completed when both radar cleared and on trajectory have been accomplished. The missile is then directed to intercept by the computer steering section.

The critical turn angle is that turn angle which if maintained from roll stabilization will cause the plan projection of the missile path to pass through the missile tracking antenna. The value of CTA derived by the circuits is not obtained as the direct solution of an algebraic function. It is determined from a match to missile trajectory characteristics obtained using circuit inputs of $R_M$, $X_G$, and $CA_o$. $R_M$ is the missile-to-tracking antenna ground range, $X_G$ is the component of displacement normal to the gyro plane of the antenna with respect to the missile, and $CA_o$ is the missile climb angle at roll stabilization (RS). $Y_G$ is horizontal distance measured in the gyro plane.

FIG. 4 shows the theoretical plan projections of missile trajectories for various values of *TA* and $CA_o$. These figures were plotted from the data calculated from the following parametric equations:

$$X_G = [690 (\sin TA)] (t - 5.5)$$

$$Y_G = 6650 \cos (367 + CA_o - 1600) - 6240 \cos [113 (t - 5.5) + (CA_o - 1600)]$$

Where distances are in yards, angles are in mils, and $t$ is the time in seconds after lift-off.

Computations are made from *RS* ($t = 5.5$ secs.).

It may be seen that these trajectory curves are the projections of helical segments since the $x$ motion is linear and the $y$ motion is sinusoidal. FIG. 5 shows the gyro plane projection of the early stages of flight. For values of $CA_o \neq 1600$ mils, the missile has a $y$ displacement at RS. For values of $TA \neq 0$ between lift-off and *RS* the missile will be displaced from the launcher in the $x$ direction. However, this motion may be disregarded since the *CTA* is specified by the value of $X_G$ as measured at *RS*.

The location of the missile-tracking-antenna with respect to the missile may be expressed in terms of the intersection of the $X_G$ and $R_M$ coordinates. The value of *CTA* is then given by the *TA* curve which would pass through this point. Since the shapes of the *TA* curves depend on $CA_o$, the required value of *CTA* may be obtained from the trajectory chart drawn for the proper value of $CA_o$. The value of *CTA* varies directly with $X_G$ and as an inverse function of $R_M$ and $CA_o$. Taking some particular examples, if $X_G = 500$ yards, $R_M = 2000$ yards then $CTA = 130$ mils for $CA_o = 1500$ mils (see FIG. 4).

The CTA circuit determines both the magnitude and polarity of this angle. The inputs to the CTA circuit are $-X_G$, CA, and $R_L$. $R_L$ is a setting of a stepped variable resistor for launcher-to-target-tracking-antenna distance which is approximately equal to the value of $R_M$ from lift-off to RS. CA is a shaft position corresponding to the missile climb angle. $X_G$ is a voltage input corresponding to the $x$ components of displacement of the antenna with respect to the missile.

The CTA circuits consist of an input network, one channel of a DC amplifier, a diode limiter, a CA card, a range parallax switch, holding circuits, and relays.

The CTA circuits are shown in FIG. 6. The critical turn angle portion of the initial turn angle circuits according to the invention utilizes a servo cabinet 10 which includes a servo and timer. The servo and timer has inputs $\pm X_M$ and $\pm Y_M$ and outputs $+X_M \cos A_G$, $-X_M \sin A_G$, $-Y_M \sin A_G$, applied to azimuth angle resolvers 10*a* and 10*b*, which may be conventional sine/cosine potentiometers, having $-Y_M \cos A_G$. Servo cabinet 10 is connected to an amplifier cabinet which includes a series connected prelaunch switching relay panel 22, a voltage summing input network 24, and a critical turn angle amplifier 26. Also included in the CTA circuits is a servo cabinet 30 including a control panel 32 having a range parallax potentiometer $R_L$ and a climb and turn servo 34.

The errors in CTA are compensated for by making DTA larger than that value determined as the turn angle equivalent of the forbidden region. The desired value of DTA is, therefore, made larger at short antenna-to-launcher distances than at long distances even though the horizontal component of missile velocity is smaller at short distances.

A diode limiter 27 across the CTA amplifier 26 limits the output to $\pm 25v$ (or $\pm 500$ angular mils). The limiter prevents overloading the amplifier when the antenna is located at a considerable distance from the gyro plane. No errors in system operation are introduced since the proper TA is zero in this case and the CTA output is therefore not used.

At roll stabilization a relay is operated which removes the input signal to the CTA amplifier and connects a capacitor C178 charged to the output voltage from the output to the input terminals. This operation makes the amplifier a holding circuit. In this state, the amplifier may be thought of as an integrator with no input. The output is therefore, a constant voltage. The value of CTA computed at RS is thereby held constant until the initial turn stage of flight is completed. $-X_G$ is obtained from the sum of $+X_M \cos A_G$ and $-Y_M \sin A_G$. These are the inputs to the CTA input network. The gain of the CTA circuit is controlled by the values of $R_L$ and CA which are introduced into the feedback path. The configuration of the $R_L$ and CA circuit was chosen in order to obtain the proper variations in gain with range and CA. The range switch divides the 1000 and 6000 yard implacement interval into 10 unequal steps for curve matching purposes. The unequal range steps are selected to provide approximately equal errors in each range interval. At each range the resistor in series with the CA potentiometer (climb and turn servo) is selected to provide the proper variation in gain-between the maximum and minimum values of CA. The second resistor (which is selected simultaneously by the operation of the Range Parallax Switch) was chosen to provide the proper gain at the given range for $CA = 1600$ mils.

The scale factor of the CTA amplifier is 0.05 volts/angular mil. The input scale factor is 1 millivolt/yard. Hence, CTA in mils is given by $(0.02) \cdot (X_G \text{ in yards}) \cdot (\text{Amplifier Gain})$.

The range approximation introduces several errors in the computation of CTA. Since antenna-to-missile ground range is not available as a shaft motion, it is approximated with the range parallax switch set for target tracking radar to launcher range. Fixed errors are introduced for any emplacement condition because:

1. The target tracking radar to missile tracking radar parallax is not considered, and
2. The range parallax switch has 10 discrete steps and thus introduces matching errors except at one range in each interval.

For each flight, additional errors are introduced because:

3. The launcher selected will not be located at the center of the launcher section, and
4. The missile will not, in general, be located directly over the launcher at RS because the nonvertical launch results in nonzero TA and CA before RS,
5. The missile turn angle can not be changed instantaneously, thus a distortion of the early part of the trajectory curve will result when the turn angle at RS is other than CTA, 6. Variation of missile velocity from nominal value will result in somewhat different trajectories.

The errors in range are more important at short antenna-to-launcher distances where they will result in larger percent errors in CTA.

The CTA approximation is shown in FIG. 7. It is seen that except at short antenna-to-launcher distances the CTA output is a good match to the trajectory curves.

The difference turn angle is the turn angle change from CTA required to move the missile path projection so that it will just skirt the forbidden region. The missile must fly on a trajectory defined by either CTA + DTA or CTA − DTA.

DTA is made up of the TA equivalent of the forbidden region radius and an allowance for errors in the calculation of CTA and DTA. The size of the forbidden region is a function of the horizontal component of missile velocity at the closest approach to the antenna (crossover). Because the missile total velocity is fixed, the missile velocity at crossover is determined by the initial climb angle and range to the antenna at roll stabilization. DTA is decreased when either of the variables $R_M$ or $CA_0$ increase. This results because the missile reaches crossover at a later time for larger values of $R_M$ or CA and consequently, has a greater $X_G$ displacement for a given turn angle.

The DTA circuit consists of a resistance network 42 on the ballistic resistor panel, a potentiometer card of the CA servo 44, input summing networks 46, 46', holding circuit 48, relays and two channels of a DC amplifier 50, 50'.

The inputs to the DTA circuit are $R_M$, the antenna-to-missile ground range, and CA, the missile climb angle. The output of the DTA circuit represents the difference turn angle in volts to a scale of 0.05*v* per angular mil.

The following description of circuit operation refers to FIG. 8. $+R_M$ and $-25v$ are applied to the ballistic resistor network 42. This network has two output voltages: a constant $-0.421v$ applied to the +DTA input network and a (−) voltage which decreases linearly as $R_M$ is increased. This latter voltage, which is applied to the CA potentiometer, is $-1.22v$ at $R_M=0$, $-0.844v$ at $R_M = 1.00v$ (1000 yds.), and $0v$ at $R_M = 5.95v$ (5950 yds.). A fraction of this voltage depending upon CA is applied to the +DTA input network 46. At CA $\leqslant$ 1333 mils (75°) this fraction is 1.0, decreasing linearly to 0 at CA $\geqslant$ 2045 mils (115°). The gain of the +DTA amplifier 50 is −16.55. The DTA output voltage varies from 20.8*v* (416 mils) at $R_M = 1000$ yards, $CA = 1600$ mils, to 6.98*v* (139 mils) at $R_M + 6000$ yards, $CA = 1600$ mils.

The operating characteristics of the DTA circuit are shown in FIG. 9.

The output of the +DTA amplifier 50 is connected to a unity gain copying amplifier 50' to obtain −DTA. Either polarity of DTA may be required in the computation of STA.

At RS the operation of relay K179 removes the input signal to the DTA amplifier and connects a capacitor C179 from output to input. This serves to hold the value of DTA, which was computed at RS, constant during the remainder of flight.

The relay amplifier, a two tube DC amplifier, has been designed specifically for operation of relays at low level DC signals. This amplifier operates a relay when the input is more negative than −10mv and releases for inputs more positive than −10mv.

Three amplifiers of this type are used (see FIG. 10*c*) in the initial turn circuits to operate (1) the radar cleared, (2) polarity of CTA, and (3) polarity of STA relays.

The following description of relay circuit operation refers to FIG. 10. Symbols in brackets refer to zones on that figure.

The initial turn phase of flight is begun by the operation of K1 (the missile away or MA relay, and K2 and K7 (the missile away locking or MAL relays.) These relays are operated when the system computer detects a vertical component of missile velocity. This occurs 3 to 3½ seconds after fire. The operation of the MAL relay initiates a 4½ second delay circuit. After this delay, K101, the MA+4 relay, is energized thereby operating the roll stabilization K179 and K102 relays. At this time, it is assumed that the missile has turned to the proper roll position and the first turn and dive orders are transmitted.

During the period from missile away to roll stabilization, the values of CTA and DTA are computed continuously. If CTA is negative, CTA relay amplifier 60 will operate K104, the CTA negative relay. This operates K105, a second CTA negative relay which holds both relays operated if CTA is negative when the RS relay operates.

The operation of the CTA negative relay K105 controls the input to the STA relay amplifier 62 (FIG. 8). For CTA positive, STA is CTA-DTA, and for CTA negative, STA = CTA + DTA. The STA negative relay K108 is controlled by the STA negative relay amplifier until the operation of K107, the RS delay relay. If STA is negative when RS delay operates the STA negative relay operates and locks.

If CTA negative and STA negative are both operated or both non-operated, then, K121, the TA zero relay, is energized causing the missile to fly a zero TA trajectory until OT. If one of these two relays is operated then the missile is directed to fly with a turn angle of STA.

K109, the RC relay, is operated when $Y_G$ becomes positive, i.e., when the missile crosses the vertical plane normal to the gyro plane containing the missile tracking radar. The RC relay operates the TA zero relay K121 thus selecting zero TA after RC. When the position of the missile at RS is between the antenna and the predicted intercept point the RC relay operates and the missile is held at zero TA during the entire initial dive.

The initial turn phase of flight is completed when radar cleared and on trajectory have both been accomplished. On trajectory is accomplished when the missile heading is such that it can reach the predicted intercept point with a ½G trajectory in the vertical plane. At this time, K8, the Not-OT relay, is released and if MA+4,K101, is operated, K4, the on trajectory locking (OTL) relay is operated. When both RC and OTL have operated, K124 and K125, the initial turn relays are released. At this time, the initial turn phase of flight is complete. From this time until intercept, missile orders are obtained from the computer steering section.

During the initial turn phase of flight the missile turn angle is controlled by a closed loop servo system. The missile receives acceleration orders in the turn direction from the computer proportional to the departure of its turn angle from the desired turn angle. This is in contrast to the control system used later in the engagement where orders are developed by the steering section of the computer. The later orders are derived by using both missile position and velocity information in combination with target information.

The missile turn orders, which are transmitted to the missile fins via oscillators 96, 98 and associated radar equipment (not shown), during the initial turn phase of flight are obtained by comparing the actual missile turn angle with STA. The circuits are shown in FIG. 11. The inputs to the $-S_T$ amplifier 74 are: (1) either the appropriate combination of CTA and DTA or Zero and (2) TA from the turn angle TA card 34 applied through a voltage summing network 72. The output of the $-S_T$ amplifier is proportional to the difference between the actual turn angle and the desired turn angle. Unless one of the gymbal limit relays K-126, K-127 is operated, thereby prohibiting turn orders, the output of $-S_T$ is multiplied by the time servo 76 output and connected to the ($G_Y$) amplifier input network 78. A copying amplifier 84 including a summing network 82 is provided to obtain $+S_T \cdot T$ which is connected to the pitch gimbal ($G_P$) amplifier input summing network 88. The order shaping circuits are not connected until 24 seconds before intercept.

During the period until on trajectory an additional input is connected to both the $G_Y$ and $G_P$ input networks. This additional input of +T volts is used to obtain the 7G dive. Since the gains of the $G_Y$ and $G_P$ amplifiers 79 and 89 are proportional to 1/T the outputs of these amplifiers each contain constant terms, representing the yaw and pitch components of the initial dive, which are modified by $-S_T \cdot T$ and $+S_T \cdot T$ respectively to provide turn orders as required. After OT the +T input to both $G_Y$ and $G_P$ is replaced by $-S_c$ as determined by the computer steering section.

After RC and OT have been accomplished the initial turn relays K-124, K-125, are released. This connects the geometric components of $-S_T$ as determined by the computer steering section to the $-S_T$ amplifier, in place of CTA, DTA, and TA, and changes the feedback path of the $-S_T$ amplifier to provide the proper gain during the latter stages of flight.

The $G_y$ and $G_P$ limiters 92, 94 in the absence of altitude order limiting prevent the output signals from exceeding ±5G. The effect of a turn angle error is to modify the $G_Y$ and $G_P$ inputs by adding a positive signal to one input and a negative signal to the other. Since −5G orders are present in the absence of a turn signal, one of the two amplifier outputs will not change because of limiting. This results in a net dive order reduction. For example, if the TA error is such that a $\sqrt{2}G$ left turn is ordered (+40 mil TA error), the Yaw order will be limited at −5G and the Pitch order will decrease to −4G. Then the turn order is given by $$\frac{1}{\sqrt{2}}(Y-P) = -1G.$$

The resultant climb order is $$\frac{1}{\sqrt{2}}(Y+P) = -6.3G.$$

If OT occurs before RC, the effective gain of the $G_Y$ and $G_P$ circuits is doubled since both $G_Y$ and $G_P$ orders change as a result of turn angle errors. This effect is cancelled by the operation of K-32, the OTL relay, which changes the feedback path and halves the gain of the $-S_T$ amplifier.

The initial turn section of the present invention is seen to comprise a number of functional units operating simultaneously to bring the missile on trajectory after launching. Although this section is energized at missile away, it does not control the missile until several seconds later, after the missile has been roll stabilized and is ready to receive orders. The dive order circuit then orders the missile on a maximum dive toward the proper trajectory path to the target. At the same time, the initial turn circuits issue orders to modify to dive order, causing a turning dive in the necessary direction. The dive order is continued until the missile is on the proper climb trajectory toward the target. The turn order — either a skirting turn or a zero turn — continues until such time as both on trajectory and radar cleared signals have been received. At that time, missile control is taken over by the computer in the systems steering section.

While the invention has been described with reference to the preferred embodiment thereof, it will be apparent that various modifications and other embodiments thereof will occur to those skilled in the art within the scope of the invention. Accordingly, I desire the scope of my invention to be limited only by the appended claims.

I claim:

1. In a missile system including a missile, a launcher, radar having a tracking antenna, and a control system for controlling the missile during the initial portion of its flight, said control system comprising: first computer means for determining a critical turn angle and providing an electrial signal representative thereof, second computer means for determining a difference turn angle and providing an electrical signal representative thereof, means providing a signal proportional to the missile turn angle, a summing circuit connected to the outputs of said first and second computers and said turn angle means for providing a missile turn signal, a time servo for providing a signal representative of the time the missile has been in flight, means for multiplying the outputs of said summing circuit and said time servo, a yaw oscillator for providing a yaw control signal, means selectively connecting the outputs of said summing means and said multiplying means to said yaw oscillator, a pitch oscillator for providing a pitch control signal, means connecting the outputs of said summing means and said time servo to said pitch oscillator, and means for transmitting said yaw and pitch control signals to said missile.

2. A system for controlling a missile during the initial portion of its flight as set forth in claim 1 wherein said first computer means comprises an amplifier, an input source providing an input signal corresponding to horizontal components of displacement of the antenna with respect to the missile, means coupling said input to said amplifier, and a feedback means for controlling the gain of said amplifier including a variable resistor for providing a resistance representative of missile to tracking antenna ground range and a potentiometer providing a representation of missile climb angle.

3. A system for controlling a missile during the initial portion of its flight as set forth in claim 1 wherein said second computer means comprises: a voltage source providing a signal representative of missile to antenna ground range, means providing a signal representative of the missile climb angle, and means for combining said signals for providing a signal representative of a difference turn angle.

4. In a missile system including a missile, a launcher, radar having a tracking antenna, and a control system for controlling the missile during the initial portion of its flight, said control system comprising: first computer means for determining a critical turn angle and providing an electrical signal representative thereof, second computer means for determining a difference turn angle and providing an electrical signal representative thereof, means providing a signal proportional to the missile turn angle, summing means connected to the outputs of said first and second commputers and said turn angle means for providing a missile turn signal, timing means providing a signal representative of the time said missile has been in flight, a multiplier connected to the outputs of said summing means and said timing means for providing the product of said turn signal and said time signal copying amplifier means for providing the negative of the output of said multiplier; means responsive to said multiplier output and said timing means output for controlling the yaw of said missile, and means responsive to the outputs of said copying amplifier means and said timing means for controlling the pitch of said missile.

5. A system for controlling a missile during the initial portion of its flight as set forth in claim 4 wherein said first computer means comprises an amplifier, an input source providing an input signal corresponding to horizontal components of displacement of the antenna with respect to the missile, means coupling said input to said amplifier, and a feedback means for controlling the gain of said amplifier including a variable resistor for providing a resistance representative of missile to tracking antenna ground range and a potentiometer providing a representation of missile climb angle.

6. A system for controlling a missile during the initial portion of its flight as set forth in claim 4 wherein said second computer means comprises: a voltage source providing a signal representative of missile to antenna ground range, means providing a signal representative of the missile climb angle, and means for combining said signals for providing a signal representative of a difference turn angle.

7. In a missile system including a missile and a radar having a tracking antenna, a turn angle computer comprising: an input signal source for providing an electrical signal representative of antenna-to-missile ground range, means connected to said input source providing an electrical signal representative of the climb angle of said missile, a first input network connected to the output of said climb angle means and said input source for providing an electrical signal representative of a difference turn angle, a DC amplifier connected to the output of said first input network for amplifying said difference turn angle signal, holding circuit means for holding the value of the difference turn angle at roll stabilization constant during the remainder of the missile flight, a second input network connected to the output of said DC amplifier for providing the negative of the difference turn angle signal, a second amplifier connected to the output of said second input network, a skirting trajectory relay amplifier, and a relay panel for selectively connecting the output of said first amplifier and the output of said second amplifier to said skirting trajectory relay amplifier.

8. In a missile system including a missile and a radar having a tracking antenna, a critical turn angle computer comprising an input network, a DC amplifier having its input connected to said input network, whereby signals related to the vertical and horizontal components of the distance between a missile and its tracking radar antenna are applied to the input of said amplifier, a diode limiter connected between the input and output of said amplifier, means for providing an electrical signal representative of the climb angle of said missile, and a range parallax switch coupled to said means for providing an electrical signal for coupling said means to said input network, said range parallax switch providing a resistance ground range between said missile and a tracking radar antenna, for controlling the gain of said amplifier.

* * * * *